United States Patent [19]

Downie

[11] 4,143,381

[45] Mar. 6, 1979

[54] METHOD FOR INFORMATION PROCESSING

[75] Inventor: Robert H. Downie, Williamsville, N.Y.

[73] Assignee: Moore Business Forms, Inc., Niagara Falls, N.Y.

[21] Appl. No.: 719,674

[22] Filed: Sep. 1, 1976

[51] Int. Cl.[2] ..... G01D 15/16

[52] U.S. Cl. ..... 346/1; 101/DIG. 13; 346/75; 346/159; 355/3 TE

[58] Field of Search ..... 346/75, 153, 159, 1, 346/140; 358/300; 101/DIG. 13; 250/324, 325; 427/19; 355/3 TE

[56] References Cited

U.S. PATENT DOCUMENTS

| | | | |
|---|---|---|---|
| 3,298,030 | 1/1967 | Lewis | 346/75 |
| 3,532,054 | 10/1970 | Zaphiropoulos | 101/426 |
| 3,582,958 | 6/1971 | Hendricks | 346/75 X |
| 3,824,012 | 7/1974 | Iizaka | 355/3 TE |
| 3,898,670 | 8/1975 | Erikson | 346/75 X |

*Primary Examiner*—Joseph W. Hartary
*Attorney, Agent, or Firm*—Watson, Cole, Grindle & Watson

[57] ABSTRACT

Information is recorded on the surface of a recording member by signal-controlled non-impact printing means, such as a jet printer or meniscus printer. The recorded information is not necessarily visible, and comprises deposits formed by ion or electron or molecular donor material. The thus-recorded information is detected by pressure contacting the surface of the recording member with a dielectric surface to form a latent image thereon. The latent image may be read or detected as a voltage analog or it may be rendered visible by the attraction thereto of electroscopic marking particles. The deposit formed by such marking particles can be transferred onto a copy sheet or the like.

15 Claims, 5 Drawing Figures

METHOD FOR INFORMATION PROCESSING

BACKGROUND OF THE INVENTION

Non-impact printing methods are known in which visual information is printed on moving paper webs or other materials as desired using a device which directs coloring matter towards the web surface under the influence of electrical signal control circuitry. Non-impact printing devices include the well-known so called jet printers, such as disclosed in U.S. Pat. Nos. 3,060,429 of C. R. Winston, 3,577,198 of D. R. Beam, 3,416,153 of C. H. Hertz et al, 3,562,757 of V. E. Bischoff, 3,769,624 of C. H. Lee et al, 3,769,627 of J. J. Stone and others. In addition, electrokinetic methods are known in which the printing head is positioned in virtual contact with the web surface such as is disclosed in U.S. Pat. No. 3,750,564 of H. Bettin.

The jet printing mechanisms of the aforementioned U.S. Patents generally disclose the generation of a stream of ink droplets at least portion of which are electrostatically charged. Signal controlled deflector means cause selected droplets to contact the moving web surface whereas droplets not forming part of the information are prevented from contacting the surface by the use of a catcher or the like, from which the unused droplets of ink are returned to the reservoir. The disclosure of Bettin in U.S. Pat. No. 3,750,564 and of J. P. Arndt in U.S. Pat. No. 3,832,579 each reveal non-impact printing methods in which a signal is employed to form droplets of finite quantity of recording material without the need for return of excess ink to the system reservoir.

It is also known to produce latent images on dielectric surfaces by pressure contact of such dielectric surfaces in patterned form with ion or electron or molecular donor material, where such latent images can be developed or rendered visible by attraction thereto of electroscopic marking particles. Such methods are useful for manifolding as disclosed in Great Britian Pat. No. 1,347,529, and also for duplicating as disclosed in U.S. Pat. No. 3,857,722.

SUMMARY OF THE INVENTION

In accordance with the present invention, information is printed on a recording member such as paper web by non-impact methods of the type previously described, wherein the thus recorded or printed information contains electron or ion, that is to say submolecular, or molecular donor material capable of forming a latent image on a dielectric surface by pressure contact therewith. The latent image so formed may be read or detected as an apparent electrostatic charge, or voltage analog, or alternatively this latent image may be rendered visible by the attraction thereto of electroscopic marking particles, following which the deposit formed by such marking particles can be transferred onto a transfer-receiving member such as a copy sheet or the like. The dielectric surface may be cleaned and re-used if desired.

Processing of information in accordance with the present invention, that is to say recording and printout, can be performed at high speed, such as 800 ft/minute, the recorded information can be visually undetectable for security purposes or aesthetic reasons yet recognizable or readable by suitable detector means, and furthermore multiple printout or copies can be obtained from non-impact printed subject matter. In addition, the method of this invention may be employed for the preparation of offset printing plates from non-impact printed subject matter and is of particular advantage for the preparation of step-and-repeat offset printing plates such as used in label and packaging material printing.

DESCRIPTION OF THE DRAWINGS

The ensuing detailed description of the invention refers to the accompanying drawings, in which FIG. 1 illustrates a preferred method of recording information in the form of donor material-containing ink deposits on the recording member surface, whereas

DETAILED DESCRIPTION OF THE INVENTION

Figure 1:
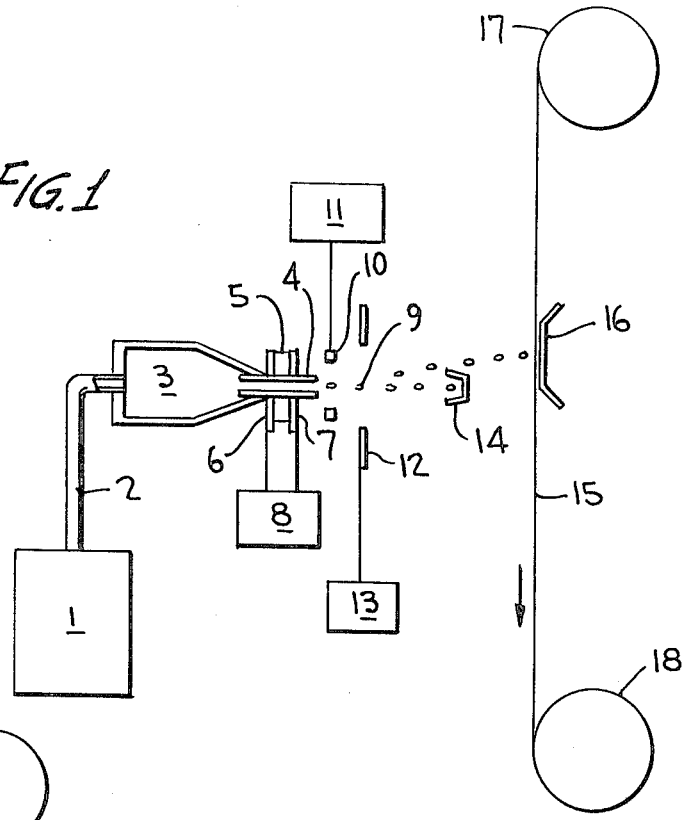

Referring to the drawings in detail, FIG. 1 illustrates a known jet printing apparatus useful in connection with the present invention. The ink jet assembly comprises reservoir 1, ink feed line 2, nozzle chamber 3 and nozzle 4. The reservoir 1 is pressurized, and thus a jet of liquid ink is ejected through nozzle 4. Piezo-electric crystal 5, control electrodes 6 and 7 and pulsing circuitry 8 break the ink stream into individual droplets 9. Annular control electrode 10 and pulsed power supply 11 are used to charge each droplet or each alternate droplet as required. Deflecting electrodes 12 are used to deflect droplets required for printing, such deflection being controlled by signal control circuitry 13. Further droplet deflecting electrodes may be used to effect droplet deflection at right angles to that shown to provide vertical displacement of droplets deposited to provide character generation. Undeflected droplets are deposited in catcher 14 from which they are returned to reservoir 1 by means not shown. Printing droplets are intercepted by paper web 15 as they travel towards grounded electrode 16. Paper web 15 moves in the direction shown from feed reel 17 to take up reel 18.

It will be understood that the jet printing method herein described is one of several non-impact printing means adapted to the present invention and that the apparatus illustrated in FIG. 1 is intended to be by way of example only, the present invention not being limited to this non-impact printer configuration.

Figure 2:
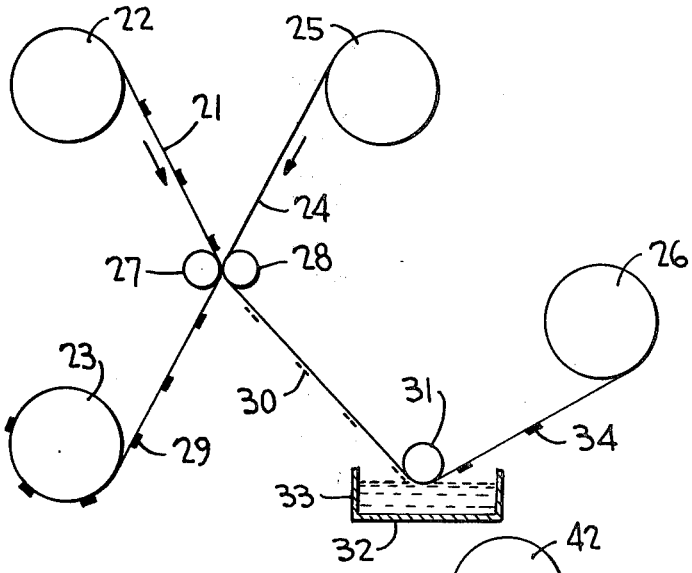
FIGS. 2, 3, 4 and 5 illustrate four embodiments of the invention with regards to latent print-out or detection.

Referring now to FIG. 2, illustrating the first embodiment of this invention, a recording member in the form of a web 21 printed for example by the method shown in FIG. 1 moves in the direction shown from feed reel 22 to take up reel 23. A dielectric-coated member 24 moves in the direction shown from feed reel 25 to take up reel 26. Printed web 21 and dielectric-coated member 24 are brought into pressure contact with each other by passage through the nip of pressure rollers 27 and 28. Printed areas 29 comprising dried ink deposits containing donor material on the surface of web 21 contact the dielectric surface of dielectric-coated member 24 at the nip, causing the formation of latent image 30 on the dielectric surface. This latent image 30 is represented symbolically in FIG. 2 as areas of negative electrostatic charge; however, as will be described fully in the following discussion, such latent image comprises ion or electron or molecular material transferred by pressure contact from the printed areas 29. Dielectric-coated member 24 containing latent image 30 is guided by roller 31 positioned above tank 32 to contact electroscopic marking particles 33 contained in the liquid in tank 32 to attract such electroscopic marking particles thereto for the formation of developed visible image deposit 34.

Figure 3:
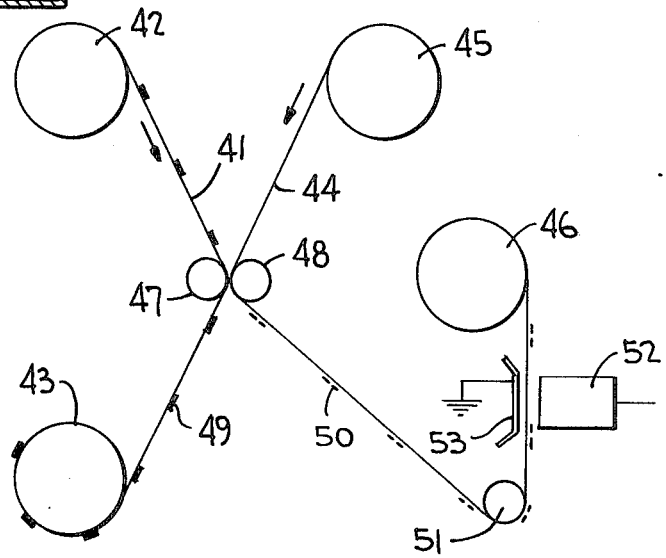

Referring now to FIG. 3, which illustrates the second embodiment of this invention, a recording member in the form of a web 41 printed for example by the method shown in FIG. 1 moves in the direction shown from feed reel 42 to take-up reel 43. Dielectric-coated member 44 moves in the direction shown from feed reel 45 to take-up reel 46. Web 41 and dielectric-coated member 44 are brought into pressure contact with each other by passage through the nip of pressure rollers 47 and 48. Printed areas 49 comprising dried ink deposits containing donor material on the surface of web 41 facing the dielectric surface of dielectric-coated member 44 cause formation of latent image 50 on the dielectric surface, this latent image 50 being represented symbolically in FIG. 3 as areas of negative electrostatic charge. Dielectric-coated member 44 passes around guide roller 51 to take-up reel 46. A grounded plate 53 is positioned as shown to contact the back surface of dielectric-coated member 44. A detector 52 such as the probe of an electrostatic voltmeter is positioned as shown to read latent image 50 as a voltage analog on the dielectric surface of dielectric-coated member 44.

Figure 4:
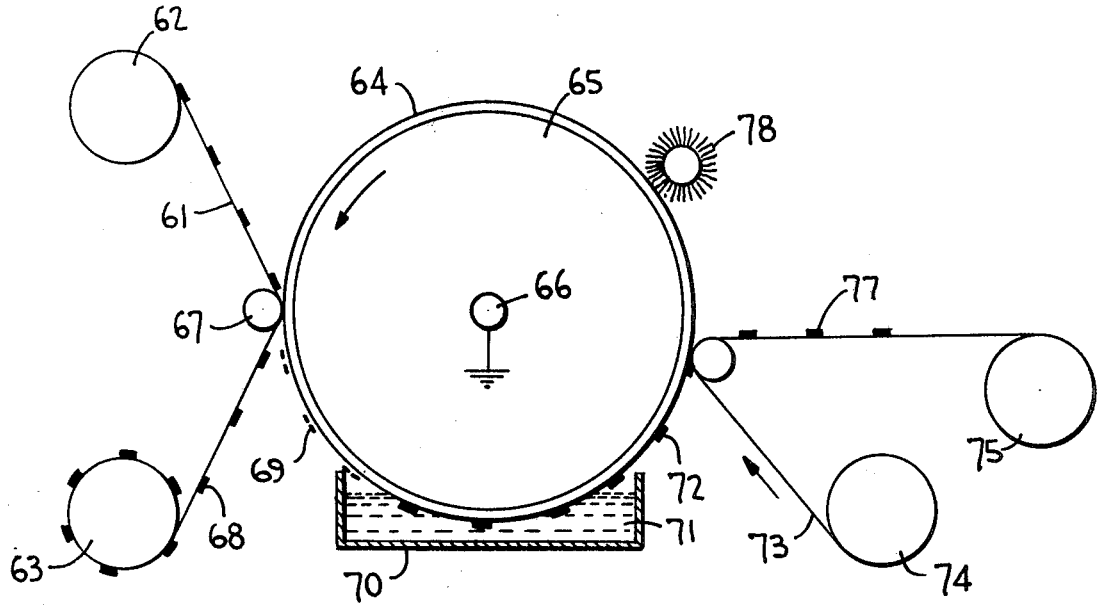

FIG. 4, illustrates the third embodiment of the invention. A recording member in the form of a web 61 printed, for example, by the method shown in FIG. 1, moves in the direction shown from feed reel 62 to take-up reel 63. Dielectric member 64 in the form of a continuous film or sleeve is positioned on electrically conducting and grounded drum 65 which rotates in the direction shown about axle 66. Web 61 passes into pressure contact with dielectric member 64 by passing through the nip between drum 65 and pressure roller 67. Printed areas 68 comprising dried ink deposits containing donor material on the surface of web 61 contact the outer dielectric surface of dielectric member 64 to form latent image 69 thereon. A tank 70, positioned as shown, contains a liquid dispersion of electroscopic marking particles 71 which are attracted to the latent image areas 69 to produce developed image deposit 72. Transfer-receiving member 73 moves in the direction shown from feed reel 74 to take-up reel 75 and contacts dielectric member surface 64 in the position shown, being maintained in line contact therewith by roller 76. Image deposit 72 is transferred to the surface of transfer-receiving member 73 to form transferred image deposit 77, using pressure transfer, absorption transfer or electrostatic transfer principles as desired, and for electrostatic transfer a directional electrostatic field, not shown, may be applied between roller 76 and grounded drum 65. Cleaning member 78, shown here as a rotary brush, removes untransferred image deposit from the surface of dielectric member 64 in preparation for immediate reuse of same.

Figure 5:
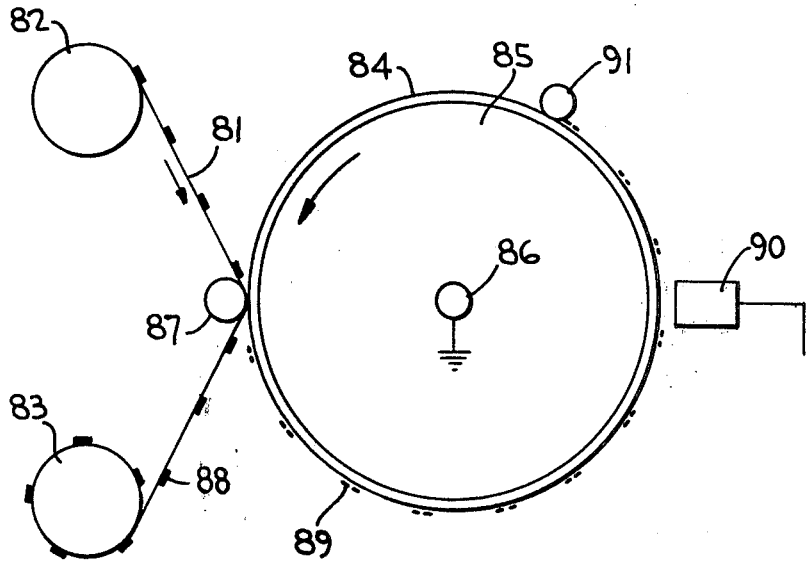

FIG. 5, illustrates the fourth embodiment of the invention. A recording member in the form of a web 81 printed for example by the method shown in FIG. 1 moves in the direction shown from feed reel 82 to take-up reel 83. Dielectric member 84, in the form of a continuous film or sleeve, is positioned on electrically conducting and grounded drum 85 which rotates in the direction shown about axle 86. Web 81 passes into pressure contact with dielectric member 84 by passing through the nip between drum 85 and pressure roller 87. Printed areas 88 comprising dried ink deposits containing donor material on the surface of web 81 contact the surface of dielectric member 84 to form latent image 89 thereon. A detector 90 such as the probe of an electrostatic voltmeter is positioned as shown to read latent image 89 as a voltage analog on the surface of dielectric member 84. Latent image neutralizing means 91 positioned as shown erases the latent image 89 from the surface of dielectric member 84 in preparation for immediate reuse.

The information which in accordance with this invention is printed by non-impact means needs to possess specific characteristics to be detectable on a dielectric surface after pressure contact in the manner described. Such printed information is required to contain material hereinafter referred to as donor material containing pressure transferrable ion or electron, that is to say submolecular, or molecular matter. Such submolecular or molecular matter when transferred by pressure contact to a dielectric surface forms a latent image thereon which is analogous with regards detection to an electrostatic latent image. Thus, although the latent image formed in accordance with this invention consists of a physical material deposit, it may be toned by attraction thereto of electroscopic marking particles as is common in electrophotography or detected as a voltage analog for instance by means of an electrostatic voltmeter.

The physical nature of the latent image deposit can be verified by application to a dielectric surface image in accordance with this disclosure of a solvent for such submolecular or molecular matter. Non-polar solvents which would not remove an electrostatic latent image may remove the latent image of the present disclosure when correctly selected. It is of course possible to select donor material capable of releasing submolecular or molecular matter which is not soluble in commonly used electrographic toner dispersions, thus allowing the present invention to function in accordance with the embodiments illustrated in FIG. 2 and FIG. 4 where the latent image formed on the dielectric surface is developed or toned by attraction thereto of electroscopic marking particles suspended in a non-polar carrier liquid.

Functional donor materials in accordance with the present invention comprise surface active agents, amines, hygroscopic salts and electroconductive polymers. For practical purposes the donor material used should form a durable deposit when printed down in an ink by non-impact methods and dried, and consequently the preferred active imaging agents are electroconductive polymers, such as those of quaternary ammonium type, reactive polyamides and surface active agents which are solid at ambient temperatures.

In accordance with this invention the aforementioned donor materials are additionally selected so as to be soluble or substantially soluble in aqueous or other polar or non-polar solvents which form the body of the ink in the non-impact printing method employed, and the requirements of such printing method with regards viscosity, conductivity and certain other relevant properties in turn influence solvent selection.

It will be realized that the ink in accordance with this invention for non-impact printing need contain only the selected donor material and a suitable solvent therefor, such donor material being selected to deposit by pressure contact submolecular or molecular matter on a dielectric surface which is suitable for the particular detection means to be employed. As a consequence, for the purpose of this invention the non-impact printed information on the recording member need not be visible, as may be advantageous for security printing. However, coloring compounds such as are used in conventional jet or other non-impact printing inks may be incorporated, if desired, without departing from the spirit of the invention.

The following examples are included to further illustrate the principles of this invention.

EXAMPLE 1

This example illustrates embodiment 1 of the invention. A visually non-detectable deposit containing a donor material was jet printed on a recording member comprising a continuous paper web moving past the printing jet at a speed of 800 ft./minute and subsequently dried. The donor material was the electroconductive polymer Calofax ECA, manufactured by ICI, in the form of 4% by weight solution in water. The paper web was a reel of cash register paper on which a straight line consisting of discrete dots was printed. The droplet-forming drive circuitry was operated at a frequency of 66kHz.

A dielectric member was prepared comprising a paper web having coated on one side thereof a 3 gsm. coating of polyvinyl butyral resin to form the dielectric surface.

A section of the jet-printed paper web was contacted with the dielectric surface of the so-produced dielectric member in the nip of a pair of pressure rollers, the applied pressure being 20 lbs. per linear inch of paper width.

The latent image thus formed on the dielectric surface was rendered visible by the application thereto of electroscopic marking particles suspended in an insulating carrier liquid, where such suspension comprised a commercially available so-called liquid toner dispersion as used in electrophotographic office copiers.

A visible image was produced on the dielectric surface corresponding in size and position to the jet-printed visually non-detectable deposit on the paper web.

EXAMPLE 2

This example illustrates embodiment 2 of the invention.

A latent image was produced on a dielectric surface as in Example 1. The dielectric surface was then passed under the probe of a Monroe Model 144S-IE Electrostatic Voltmeter. The latent image was read as a negative voltage of 3 volts, whereas in the background areas free of latent image a random noise voltage of ±0.025 Volts was detected.

EXAMPLE 3

This example illustrates embodiment 3 of the invention.

A deposit containing a donor material was jet-printed on a paper web as in Example 1, the donor material being the same as in Example 1.

A dielectric-coated metal drum was prepared by coating a polished aluminum drum with a 10% by weight solution of polyvinyl butyral resin in ethanol to a wet film thickness of 0.0015 inch. The coating was dried. The thus-formed dielectric surface was pressure-contacted with the printed web as in Example 1 to produce a latent image thereon, the pressure of 20 lbs. per linear inch being applied between a nip roller and the drum. The latent image on the dielectric surface was rendered visible as in Example 1. and the visible image formed by a deposit of electroscopic marking particles was electrostatically transferred to a plain paper transfer-receiving member. The dielectric surface was subsequently cleaned in preparation for re-use by means of a rotating cotton brush wetted with an aliphatic hydrocarbon solvent.

EXAMPLE 4

This example illustrates embodiment 4 of the invention.

Example 3 was repeated, with the exception that the latent image on the dielectric surface was detected as in Example 2. The latent image was read as a negative voltage of 13 volts, whereas the random noise in the background comprised 2–3 volts negative.

The latent image was subsequently erased from the dielectric surface in preparation for immediate re-use by the application thereto of a felt pad slightly moistened with trichloroethylene.

EXAMPLE 5

This example also illustrates embodiment 4 of the invention.

Example 4 was repeated with the exception that the jet-printed donor material containing ink comprised a 1% by weight solution of Calofax ECA in water. In this instance the latent image was read as a negative voltage of 3 volts, whereas the random noise in the background comprised 1.5 volts negative maximum.

EXAMPLES 6–9

Examples 1–4 were repeated with the exception that the donor material-containing ink comprised a 5% by weight solution in water of Dow Corning ECR 34 electroconductive polymer. This polymer is of the vinylbenzyltrimethyl ammonium chloride type disclosed in U.S. Pat. No. 3,011,918.

The latent image voltage was 0.5 volts negative in Example 7, whereas the random noise in the background comprised 0.4 volts positive. In Example 9 the latent image voltage was 1.5 volts negative, the random background noise being immeasurable.

EXAMPLES 10–13

Examples 6–9 were repeated except that the donor material-containing ink comprised a 5% by weight solution in water of Calgon Corporation Conductive Polymer 261, disclosed in U.S. Pat. No. 3,544,318. Image voltages of Examples 11 and 13 were comparable to those of Examples 7 and 9.

EXAMPLES 14–17

Examples 1–4 were repeated except that the donor material comprised a reactive polyamide, amine number 230–246, applied by jet-printing as a 1% by weight solution in isopropyl alcohol. Image voltages of Examples 15 and 17 were approximately half of those of Examples 2 and 4, whereas the random noise in background areas was comparable to that of Examples 2 and 4.

EXAMPLES 18–21

Examples 14–17 were repeated except that the donor material comprised a reactive polyamide, amine number 370–400, applied by jet-printing as a 1% by weight solution in isopropyl alcohol. Image and random background noise voltages were comparable with those of Examples 15 and 17.

Generally reactive polyamides with amine numbers within the range 230–450 have been found to be useful donor materials in accordance with this invention.

EXAMPLES 22–25

Examples 1–4 were repeated except that the donor material-containing ink comprised a 1% by weight solution in water of an anionic surface active agent, dodecylbenzene-sulfonic acid sodium salt. The surface active agent caused scatter of ink droplets which resulted in the printed image being of poor definition, but quite adequate for detection and information processing for instance for sorting purposes. Image voltages were 0.9 volts negative in Example 23 and 2.5 volts negative in Example 25. Random background noise was generally slightly positive with some negative background noise due to droplet scatter, generally 0.2 volts in Example 23 and 0.5 volts in Example 25.

EXAMPLES 26–29

Examples 22–25 were repeated except that the donor material-containing ink comprised a 1% by weight solution in water of a cationic surface active agent di-isobutyl phenoxy ethoxy ethyl dimethyl benzyl ammonium chloride monohydrate. Image voltages of Examples 27 and 29 were of the same polarity and general level of those of Examples 23 and 25.

EXAMPLES 30–58

Each of Examples 1–29 was repeated with the exception that the polyvinyl butyral dielectric coating was replaced by a coating of the high molecular weight linear polyester resin Vitel PE200, manufactured by Goodyear. The Vitel PE200 resin was applied from a 20% by weight solution in a solvent mixture comprising ethyl acetate and toluene in equal parts by volume. The dried coating weights of the polyester resin coatings of Examples 30–58 were equivalent to those of the polyvinyl butyral resin coatings of Examples 1–29.

It should be pointed out that the invention is not dependent for its effectiveness on the composition of the dielectric coating, and in addition to those disclosed in the foregoing other dielectric materials have been used successfully including alkyd resins, epoxyesters, acrylic resins and the like.

A surprising feature of the present invention is the consistency of formation of latent images of apparent negative polarity regardless of whether the donor material is cationic or anionic in nature. Furthermore, in those instances where the donor material comprises an electroconductive resin or a polyamide, the latent image is also of apparently negative polarity. This phenomenon indicates that at least the portion of the donor material molecule or submolecular particle which transfers by pressure contact to the dielectric surface is consistently the negatively charged or oriented or polarized radicle or portion thereof. No theoretical basis for this phenomenon is known.

In the examples, the proportion of donor material in the ink varies within the range 1% to 5%. Donor material concentrations below 1% have been found to produce latent images of poor contrast, whereas no substantial improvement in latent image contrast or definition has resulted from increasing the donor material content of the ink to exceed 5% by weight. These proportions apply to the donor materials disclosed in the examples, and alternative donor materials may be found to operate advantageously when contained in inks in proportions above and below this range.

It will be realized that many variations may be made to each of the embodiments described in the foregoing. For example, the web used for non-impact printing need not be continuous but may be in sheet form. Further, in those embodiments in which the latent image is rendered visible by the application of electroscopic marking particles may be chosen to provide image toning suitable for OCR read-out or alternatively such particles may be magnetic to allow MICR read-out. Furthermore the configuration of embodiment 3 may be adapted to the production of lithographic printing plates as the electroscopic marking particles may be so selected that the image deposit formed by same is ink receptive and can be transferred onto a water-receptive substrate. In those instances in which the latent image is read directly without being rendered visible, the detector or sensor may control circuitry for sorting, classifying, verifying or identifying as desired.

In all instances the non-impact printed recording member remains available for subsequent and repeated latent image formation as often as desired or required from case to case. In addition, as the non-impact printed recording member is not used directly for sorting, classifying, verifying or identifying, the printed information need not be visible and thus such printed information can be undetectable unless specialized equipment is employed for detection and can be thus considered as tamper proof.

There has been described a novel method and means for non-impact printing of information and for the detection or read-out of same, and there has been disclosed a range of materials which can be used in accordance with this invention. It should be understood that the Examples given are to be construed as illustrative only and not in a restrictive sense as other changes and substitutions may be made as will be obvious to those skilled in the art without departing from the spirit of this invention.

Having thus described my invention, I claim:

1. A method of information processing comprising the steps of:

(a) printing information in the form of an ink deposit on the surface of a recording member by non-impact technique, said ink deposit containing a donor material which is spontaneously capable of transferring submolecular matter to form a latent image analog on a dielectric surface pressure-contacted thereagainst when said ink deposit is dry;

(b) drying said printed ink deposit containing said donor material on said surface of said recording material;

(c) pressure contacting said surface of said recording member containing said dried ink deposit thereon with a dielectric surface in order to form a latent image analog on said dielectric surface, said latent image analog being formed by the submolecular matter donated by said donor material; and (d) detecting said latent image analog on said dielectric surface.

2. The method of information processing as claimed in claim 1, wherein said donor material is a water-soluble polymer.

3. The method of information processing as claimed in claim 1, wherein said donor material is a reactive polyamide.

4. The method of information processing as claimed in claim 1, wherein said donor material is a surface active agent.

5. The method of information processing as claimed in claim 1, wherein said step (d) comprises forming a visible image deposit on said dielectric surface by depositing electroscopic marking particles on said latent image.

6. The method of information processing as claimed in claim 5, wherein after said visible image deposit is formed, said electroscopic marking particles are transferred to a transfer-receiving member.

7. The method of information processing as claimed in claim 6, wherein after said electroscopic marking particles are transferred to a transfer-receiving member said dielectric surface is cleaned to remove any untransferred image deposit.

8. The method of information processing as claimed in claim 5, wherein said electroscopic marking particles are deposited on said latent image by passing said dielectric surface with said latent image thereon through a tank containing said electroscopic marking particles in liquid suspension.

9. The method of information processing as claimed in claim 1, wherein said step (d) comprises scanning said dielectric surface with a voltage-sensing means.

10. The method of information processing as claimed in claim 9, wherein after said dielectric surface is scanned with said voltage-sensing means said latent image is erased from said dielectric surface.

11. The method of information processing as claimed in claim 1, wherein said latent image is invisible.

12. The method of information processing as claimed in claim 1, wherein said recording member of step (a) comprises a paper web.

13. The method of information processing as claimed in claim 1, wherein said dielectric surface comprises a paper web coated with a polyvinyl butyral resin.

14. The method of information processing as claimed in claim 1, wherein said dielectric surface comprises an aluminum drum coated with a polyvinyl butyral resin.

15. The method of information processing as claimed in claim 1, wherein said ink deposit on the surface of said recording member forms a latent image analog on said dielectric surface in the absence of an electrostatic charging step.

* * * * *